US005708998A

United States Patent [19]

Torbik

[11] Patent Number: 5,708,998

[45] Date of Patent: Jan. 20, 1998

[54] CERVICAL PILLOW

[75] Inventor: Angela M. Torbik, Long Beach, Calif.

[73] Assignee: Anabolic Laboratories, Inc., Irvine, Calif.

[21] Appl. No.: 401,403

[22] Filed: Mar. 8, 1995

[51] Int. Cl.[6] ..... A47G 9/00

[52] U.S. Cl. ..... 5/636; 5/645

[58] Field of Search ..... 5/636, 637, 638, 5/645; D6/601

[56] References Cited

U.S. PATENT DOCUMENTS

| | | | |
|---|---|---|---|
| D. 35,497 | 12/1901 | Meinecke . | |
| 50,873 | 11/1865 | Kane . | |
| D. 174,778 | 5/1955 | Smith . | |
| D. 250,985 | 2/1979 | Armstrong . | |
| D. 256,728 | 9/1980 | Allen . | |
| D. 282,427 | 2/1986 | O'Sullivan . | |
| D. 298,198 | 10/1988 | O'Sullivan . | |
| D. 308,787 | 6/1990 | Youngblood . | |
| 655,087 | 7/1900 | Jones . | |
| 1,020,444 | 3/1912 | Platt | 5/636 |
| 1,386,652 | 8/1921 | Patton . | |
| 1,446,290 | 2/1923 | Dessau . | |
| 2,295,906 | 9/1942 | Lacour | 5/636 |
| 2,956,291 | 10/1960 | Hauptman . | |
| 3,243,828 | 4/1966 | McCarty . | |
| 3,290,704 | 12/1966 | Willis | 5/636 |
| 3,400,413 | 9/1968 | LaGrossa . | |
| 3,443,267 | 5/1969 | Schuckman . | |
| 3,521,310 | 7/1970 | Greenwalt | 5/636 |
| 3,667,074 | 6/1972 | Emery . | |
| 3,753,263 | 8/1973 | Willis | 5/636 |
| 3,757,365 | 9/1973 | Kretchmer . | |
| 3,848,281 | 11/1974 | Mathews . | |
| 3,849,810 | 11/1974 | Degen . | |
| 3,858,257 | 1/1975 | Young | 5/636 |
| 4,349,925 | 9/1982 | Macomber | 5/636 |
| 4,375,112 | 3/1983 | Leonhart . | |
| 4,468,824 | 9/1984 | O'Hanlan . | |
| 4,513,462 | 4/1985 | Thomas . | |
| 4,660,239 | 4/1987 | Thomas | 5/645 |
| 4,754,513 | 7/1988 | Rinz . | |
| 4,768,248 | 9/1988 | O'Sullivan . | |
| 4,783,866 | 11/1988 | Simmons et al. . | |
| 4,876,755 | 10/1989 | Parrish . | |
| 4,949,411 | 8/1990 | Tesch . | |
| 5,038,432 | 8/1991 | Robillard et al. | 5/645 |
| 5,088,141 | 2/1992 | Meyer et al. | 5/636 |
| 5,168,590 | 12/1992 | O'Sullivan . | |
| 5,363,524 | 11/1994 | Lang | 5/645 |

FOREIGN PATENT DOCUMENTS

| | | | |
|---|---|---|---|
| 36813 | 1/1970 | Australia | 5/636 |
| 1127948 | 12/1956 | France . | |
| 3138463 | 9/1981 | Germany . | |
| 26072 | of 1909 | United Kingdom . | |
| 2527 | of 1911 | United Kingdom | 5/645 |

*Primary Examiner*—Alexander Grosz
*Attorney, Agent, or Firm*—Knobbe, Martens, Olson & Bear, LLP

[57] ABSTRACT

The pillow of the present invention provides proper cervical support whether the sleeper is on his back or on his side. Side sections including cutouts on the left and right of the pillow provide clearance for the airways during side sleeping, and a multi-level construction provides the proper head and neck support for either back or side sleeping positions. A high quality fiber is used in rolled and layered sections to provide comfort for the sleeper and resiliency of the pillow over prolonged use. Dual neck rolls of different diameters allow two sleepers of different neck sizes to alternately use the same pillow.

11 Claims, 3 Drawing Sheets

CERVICAL PILLOW

BACKGROUND OF THE INVENTION

1. Field of the Invention

The present invention relates to a pillow which provides cervical support during sleep, and, in particular, to a pillow which provides proper support whether the user is laying on his back or side.

2. Description of the Related Art

Cushion or pillow designs range from the merely decorative to those providing anatomical support. Generally, pillows which are placed on chairs or sofas for decorative effect, and sometimes of elaborate design, are inadequate to use for comfortable sleep. In particular, fluffy decorator pillows, as well as down or feather pillows, will compress upon minimal weight and provide little support for the neck or head.

Sleep is required to recover from the day's exertions and to prepare for another day's activities. Exhaustion may be mental and/or physical. An inadequate night's sleep can result in prolonged fatigue continuing over several days. In some cases, the act of sleeping itself contributes to physical ailments which can in turn affect a person's mental attitude. That is, improper or inadequate support of a person's body during sleep can bring aches and pains the next morning. If this is continued and not corrected, medical treatment may later be required for relief.

Most sleeping problems are generated by insufficient support of the head and neck by the pillow and a resultant misalignment of the head with the neck and spinal column. Since most adults sleep from one-fourth to one-third of the day, or 6 to 8 hours, proper cervical support is required to help prevent chronic neck and/or back pain that is caused by muscle or nerve strain. Incorrect pillow support will cause the muscles to compensate, and the muscle tension will not allow the body to be fully relaxed during sleep. Nerve endings located near the tensed neck or back muscles may become compressed and cause pain. Unless the head and neck are properly supported and the mattress sufficiently firm, a person will not have his or her back in the proper horizontal alignment with the head and neck. Thus, there will be neck and/or back discomfort.

A few prior art pillows are designed to support a person who sleeps in the medically recommended back sleeping position. This type of pillow is typically constructed from foam rubber or a loose fiber filling, which is somewhat rigid and lacking in enough resiliency to be comfortable. Further, it is well known that most persons have a preferred position other than on the back, and these persons may alternate positions several times during a sleep period. However, sleeping face down, where the chest is in contact with the bed and the head is turned to the side, should be discouraged. This position promotes an exaggerated twisting of the head and neck, and neck muscle strain results.

When an individual sleeps on the side or face down, and sometimes when the individual is on her back, the head may be turned to one side. This requires consideration of the face and the consequences of too rigid a support surface thereon. Too much pressure on the chin, cheekbone, ear, or forehead causes discomfort. In addition, the skin may be stretched and contorted. However, too soft a support could allow the face to sink into the cushion and lead to breathing difficulty or even suffocation.

In view of the foregoing, a pillow is needed that provides proper, yet comfortable support for the back and side sleeping positions which are most likely to be assumed by an individual. That is, proper support by a pillow should also allow for movement from the back to the side and vice versa.

SUMMARY OF THE INVENTION

The cervical pillow of the present invention satisfies this need in the prior art by supporting and relieving pressure on muscles, bones, and ligaments, while allowing use by a sleeper positioned on either his back or side. An important feature of the present invention, offering advantages over the prior pillow designs, is a side cutout design for side sleeping use which provides comfortable support without breathing obstruction. Other important features of preferred embodiments of the present invention include i) the use of rolled or folded triangular sections of high quality fiber material for durable, comfortable, and firm support, ii) a multi-level design to provide proper support and alignment of the head and neck for either back or side sleeping by the user, and iii) dual neck rolls so that a single pillow may accommodate two differently sized users.

In the present invention, a cutout is located on at least one, but preferably both, of the side edges of the pillow, forming a notched periphery. The cutout side sections result in generally an inverted H-shape. The cutout side sections allow support for the side of the head and face without obstructing the nose and mouth.

In the preferred embodiments of the present invention, the neck rolls form two portions of the pillow and an intermediate, or third, portion is formed between the two neck rolls and the notched sides. This intermediate portion has a thickness less than both of the neck rolls. When a sleeper is on her side, the intermediate portion provides support for the side of the head and face, which rest closer to the mattress than the neck. The sleeper's lower shoulder is positioned adjacent the bottom neck roll, below the pillow.

Also in preferred embodiments, the intermediate portion is bisected by a central portion or depression, such that the intermediate portion is formed on either side of this central depression. Unlike prior designs that provide only 2 or 3 pillow levels, the central depression in the present invention optionally provides a fourth level. This central depression and two intermediate portions are located laterally between the top and bottom neck rolls. When a sleeper is on his back, the central depression provides a recess to receive the back of the head without tilting the head and chin toward the sleeper's chest. This lowered position of the head, relative to the neck, promotes the proper alignment of the neck and back. The shape of the central depression may be of any type, as long as it receives the back of the head without partially enclosing it or pressuring the sides of the head near the ears.

Also, the present invention preferably accommodates persons of more than one size comfortably, since pillows are often interchanged within a household and/or may be proffered to overnight guests. That is, one neck roll has a diameter greater than the other. When the pillow is rotated about its longitudinal axis, either the larger or smaller neck roll may be used without loss of the advantages of the present invention.

The preferred method of manufacturing the cervical pillow of the present invention includes the steps of 1) cutting the outer casings to include side cutouts, 2) stitching the casings together along one long edge and both sides, 3) inserting the neck rolls and material for the remaining portions, and 4) stitching the remaining edge closed. The neck rolls and intermediate portions are preferably formed from triangular sections of high quality polyester fiber material. An additional step of stitching material within the shape of the central depression may be performed anytime during or after Step 2.

For further accommodation of different users, the pillow may be manufactured in several sizes, proportionately dimensioned. Further advantages and applications will become apparent to those skilled in the art from the following detailed description and the drawings referenced herein.

DETAILED DESCRIPTION OF THE PREFERRED EMBODIMENTS

Figure 1:
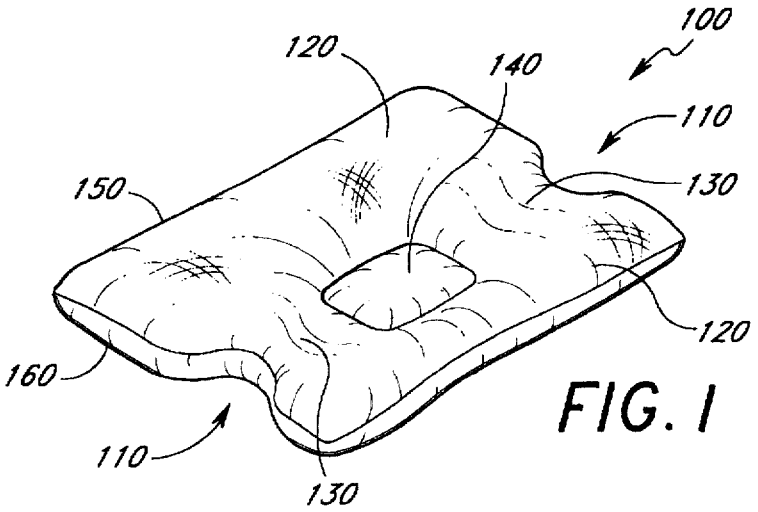
FIG. 1 is a top perspective view of a first preferred embodiment of the present invention, illustrating the notched periphery and multi-level construction for head and neck support.

A preferred embodiment of a cervical pillow 100 constructed in accordance with the present invention is illustrated in perspective in FIG. 1. An important feature is a cutout 110, included in this embodiment on the left and right sides of the pillow 100, for side sleeping use. The cutouts 110 allow comfortable support without breathing obstruction, since the area of the mouth and nose is generally positioned at the cutout 110 with the cheek resting on the side section of the pillow 100.

Figure 3:
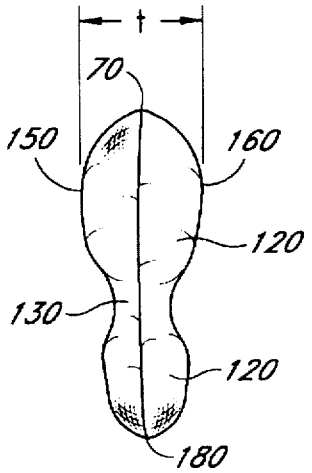
FIG. 3 is a side elevational view of the embodiment of FIG. 1, illustrating the two sizes of neck rolls in relation to the intermediate portion of the pillow.

In addition, another important feature is a multi-level construction of 2–4 pillow thicknesses for the present invention. The multi-level construction included in this embodiment comprises four thicknesses in the pillow 100, where thickness t is measured as shown in FIG. 3, to provide proper support and alignment of the head and neck for either back or side sleeping by the user. As described further below, the multiple pillow thicknesses refer herein specifically to thickness or to diameter, depending upon whether the inserted material is folded/loose-filled or rolled, respectively. The four thicknesses include two different diameters from dual neck rolls 120 so that a single pillow may accommodate users having two different neck sizes; i.e., one neck longer than the other. The two different diameters of the neck rolls 120 comprise the largest thicknesses of the multi-level pillow construction since during either side or back sleeping the neck is positioned furthest from the mattress and thus requires an appropriately elevated support.

A third, intermediate portion 130, located between the two neck rolls 120, and a fourth portion or central depression 140, stitched generally in the middle of the intermediate portion 130, comprise the reduced thickness of this multi-level construction. When the user is asleep on his back, the back of the user's head naturally rests closer to the mattress than the user's neck. In this preferred embodiment 100 of the cervical pillow, the back of the user's head rests in the central depression 140. The central depression 140 is of the least thickness in the pillow construction so that the resultant alignment of the head with the vertebrae in the neck is straight, thereby avoiding muscle tension. The intermediate portion 130 serves to softly cradle the user's head during back sleeping, so that the head does not roll too far to one side and result in misalignment of the head and discomfort upon waking. During side sleeping, the intermediate portion 130 provides an elevation somewhat raised from the central depression 140 in order to comfortably support the side of the head and correctly position the neck.

Prior pillow designs purporting to properly support the head were limited to back sleeping use. That is, no consideration was given to clearing a path for the airways, or relieving pressure around the mouth and nose, during side sleeping use, as is done by the present invention using side cutouts 110. And, the construction of these previous pillows is such that the thickest portions are arranged to be on either side of the head during back sleeping and not under the neck of the user. Thus, these pillows must be rotated by 90 degrees in order for the neck, which requires the greatest thickness of the pillow, to be properly supported. If these pillows are not rotated, the increased thickness could obstruct breathing during side sleeping use.

Figure 2:
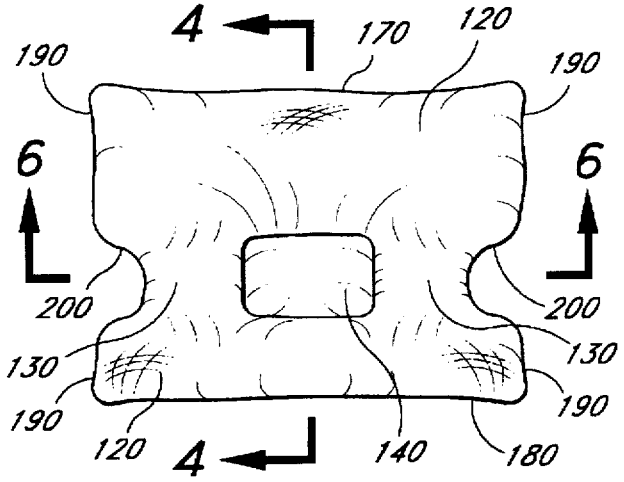
FIG. 2 is a top plan view of the embodiment of FIG. 1, illustrating the side cutouts and central depression for receiving the back of a user's head during back sleeping.

As indicated in FIGS. 1 and 2 for the pillow 100 constructed in accordance with the present invention, an upper casing 150 length and width matches a lower casing 160 construction. The lateral dimension of the pillow 100 is referred to herein as the width of the pillow 100, and the pillow length refers herein to the longitudinal dimension. Also, in the following description, the upper casing 150 contacts the sleeper and the lower casing 160 contacts the mattress. Preferably, the casings 150, 160 are of a 65–35% polyester-cotton blend material providing the characteristics of being hypoallergenic, durable, and easy to maintain. Longer pillow edges 170, 180 in contact with the user's neck may be straight and parallel to each other, or the neck edges 170, 180 may be somewhat convex, concave or of some other shape.

Referring to FIG. 2, the two halves of the pillow 100 formed by transversely bisecting the pillow 100 are mirror images. If the pillow 100 of this embodiment is cut in two longitudinally, through the cutouts 110, one section would not be the mirror image of the other section. Although, as will be seen in the alternate embodiment of FIGS. 12–16, wherein neck rolls 120' are of equal size, the longitudinal halves may be mirror images.

The left and right side edges refer herein to the pillow's notched periphery, forming the cutout sides, along the width of the pillow 100. Each side edge includes straighter sections 190 that form corners with the top and bottom neck edges 170, 180, respectively, as well as curvilinear sections 200 that comprise each cutout 110. While the cutouts 110 are not limited in shape in the present invention, they preferably form approximately half of a circle, ellipse, or ovoid.

Alternately, the cutouts or notches 110 may be V or square-shaped, or form part of another polygonal shape, while still achieving the purposes of the present invention. That is, the aforementioned shapes, and others too numerous to mention, may be used to achieve the functional advantages of the present invention, since the invention is not limited to a particular cutout shape. In fact, the applicant expressly reserves all trade dress rights to a particular cutout shape not necessarily shown here.

The central depression 140 is generally an elongated oval shape in the preferred embodiment of the present invention, as illustrated in FIG. 2. However, the shape of the central depression 140 may be of any type, as long as it receives the back of the head without pressuring the sides of the head near the ears.

The pair of neck rolls 120 extend substantially through the lengths of the top and bottom pillow portions, near the long edges 170, 180 of the pillow 100 and perpendicular to the user's body. The neck rolls 120 provide the greatest diameters of the pillow 100 and are preferably formed by rolling triangular sections of material similar to forming crescent rolls in baking. In the first preferred embodiment, the distance from the top neck edge 170 toward the intermediate portion 130 is greater than for the distance from the bottom neck edge 180 toward the intermediate portion 130, where the intermediate portion 130 has thickness less than either neck roll 120, as shown in FIG. 3. Alternately, the position of the larger/smaller neck rolls 120 may be reversed, such that the distance from the top edge to the intermediate portion 130 is smaller to accommodate a smaller user.

Figure 4:
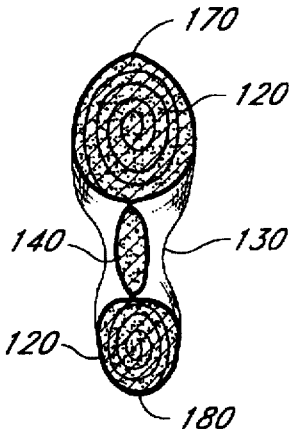
FIG. 4 is a cross-sectional view along lines 4—4 in FIG. 2, illustrating the multi-level construction including the central depression.

FIG. 4 is a cross-sectional view taken along lines 4—4 of FIG. 2, and illustrates the fourth and least thickness of the central depression 140 of the first embodiment. As discussed above, a cross-sectional view taken along lines 4—4 in the opposite direction, toward the right side edge, would be a mirror image. Preferably, the same material of 100% polyester fiber is used to create the neck rolls 120 and the intermediate portion 130, as well as the central depression 140. Somewhat similar to the neck roll formation, the side sections of the intermediate portion 130, on each side of the central depression 140, are formed by folding triangular sections of material to create layers, rather than rolls. The central depression 140 contains separate layers of the same polyester material, or it may be loose-filled with the material.

Figure 5:
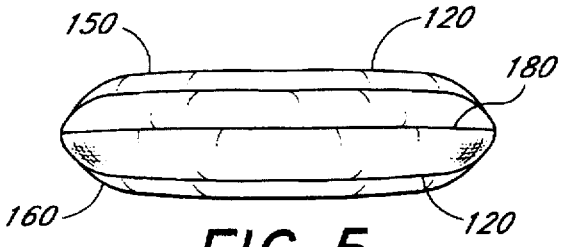
FIG. 5 is a front elevational view of the embodiment of FIG. 1, further illustrating the dual neck rolls.

The difference in neck roll sizes in the first preferred embodiment 100 of the cervical pillow of the present invention is further illustrated in the front elevational view of FIG. 5. During use, the so-called top neck edge 170 may be positioned above the user or under his neck, depending upon his neck size, merely by rotating the pillow 100 by 180 degrees. The advantage of the construction of dissimilar top and bottom neck portions is that the pillow 100 can thus accommodate persons of differing neck sizes.

Figure 6:
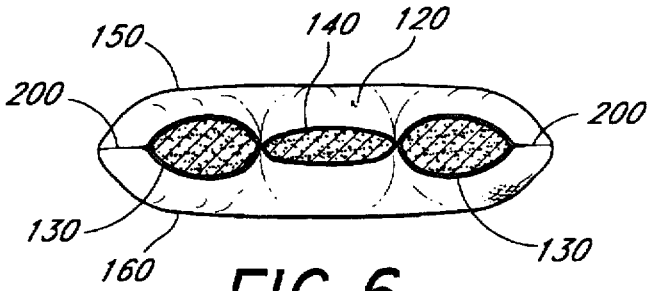
FIG. 6 is a cross-sectional view along lines 6—6 in FIG. 2, further illustrating the multi-level construction including the central depression.

FIG. 6 is another cross-sectional view illustrating the four levels of thickness of the pillow 100. However, if the view were taken along the same lines 6—6 toward the bottom edge 180 of the pillow 100, a mirror image would not be obtained, since the bottom neck roll 120 is somewhat smaller than the top neck roll 120 in the first preferred embodiment of FIG. 2.

Method of Construction

A preferred method of constructing the cervical pillow 100 of the present invention includes the following steps:

1) cutting a casing material to form the upper and lower casings 150, 160 with side cutouts 110;
2) stitching the casings 150, 160 together along the cutout sides and the top edge 170, then reversing the casings 150, 160 (i.e., pulling the material inside out) so that only finished seams are exposed and the raw edges are hidden;
3) inserting the material for the central depression 140 and stitching the shape in the center for receiving the back of the user's head;
4) inserting the neck rolls 120 and material for the intermediate portion 130; and
5) stitching the bottom edge 180 of the casings 150, 160 closed to complete the pillow 100.

Step 1 may include cutting only one cutout 110, and, as will be illustrated in an alternate embodiment described below, Step 3 may omit stitching the central depression 140, thereby eliminating the hollow or depression for receiving the head and creating a tri-level rather than a quad-level pillow construction. The neck rolls 120 are preferably formed by rolling triangular sections of polyester material. The intermediate portion 130 is preferably formed by inserting layered sections of similar material, where the layers have been formed by folding triangular sections of the polyester material. Other ways to form the intermediate portion 130 and/or central depression 140 is through rolled or loose fillings of the sleeping grade fibers.

Optionally, the cutouts 110 may be made closer to the top or bottom edge 170 or 180, respectively, in order to accommodate differently sized neck rolls 120. Also, the portions of the pillow 100 containing the neck rolls 120 may be separately defined by additional stitching either before or after the neck rolls 120 are inserted, wherein the stitching is generally parallel to the top and bottom edges 170, 180 of the pillow 100. In addition, the order of the initial stitchings and insertions of Steps 2–4 may be modified without affecting the advantages offered by the present invention.

Another important feature of the present invention is the use of triangular sections of high quality filling material, either folded or rolled to form the various portions. The pillow 100 constructed in accordance with the present invention provides the support to the neck required to ensure comfortable slumber, which is partially achieved through the use of sleeping grade polyester fiber. This grade of polyester fiber has a consistent, finished (versus raw) appearance and may be obtained as loose filling or as sheets which can be rolled or folded. This type of fiber is rated by the U.S. Sleep Council as providing firm sleep support, yet with a resiliency that allows the pillow to repeatedly resume its original shape, even after prolonged use. This high quality material guarantees years of comfortable use. It is sufficiently deformable to provide adequate conformity to the head for comfort. Thus, the filling used in the preferred embodiment of the present invention falls nicely between, on the one hand, decorative polyester fiber and down, which provide little or no support, and, on the other hand, foam rubber, which provides uncomfortably rigid support.

Production of smaller or larger pillows, including changes in the width and length of the pillow, further serves to accommodate a variety of sleepers with different neck and head sizes. Preferred pillow sizes, by user weight/neck circumference, include: approximately 20"x15" (Small) for persons up to 105 lbs/10–13½" neck, 25-½"x17-¾" (Medium) for persons 106–200 lbs/14–16" neck, and 28"x18" (Large) for persons over 200 lbs/16" neck.

Alternate Embodiments

Figure 7:
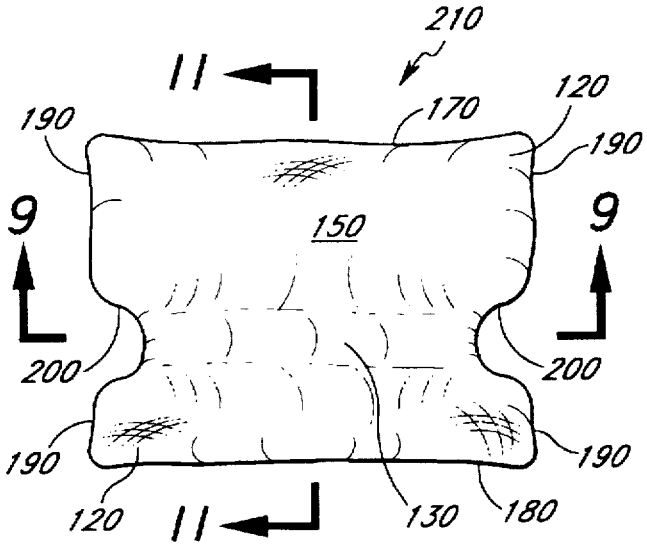
FIG. 7 is a top plan view of a second preferred embodiment of the present invention, illustrating the side cutouts and dual neck rolls.

FIGS. 7–11 illustrate a second preferred embodiment of a cervical pillow 210 of the present invention. As shown in FIG. 7 as compared with FIG. 2, the feature lacking in this embodiment is the central depression 140. Thus, this embodiment includes the features of the side cutouts 110 and the dual neck rolls 120 of different diameters. And, although the shapes of the cutouts 110 are the same for FIGS. 1–16, it is understood that other shapes may be used in the present invention. In the following discussion of alternate embodiments, like numbers will refer to like components.

If the pillow 210 of FIG. 7 is halved along its width, such that each half contains one cutout 110, then the halves would be mirror images, as for the first preferred embodiment. Also, as before, if the pillow 210 of the second embodiment is divided longitudinally through the cutouts 110, the resultant sections would not be mirror images due to the different neck roll sizes.

Figure 8:
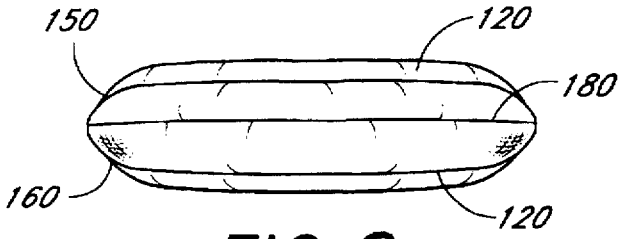
FIG. 8 is a front elevational view of the embodiment of FIG. 7 illustrating the two neck roll sizes.
Figure 9:
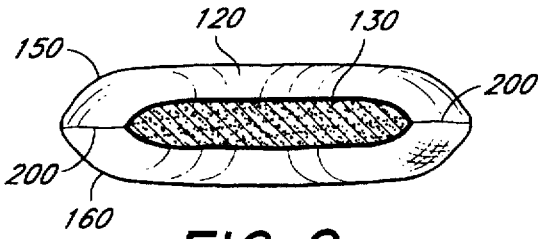
FIG. 9 is a cross-sectional view along lines 9—9 of FIG. 7, illustrating the lesser thickness of the intermediate portion of the pillow

Referring now to FIGS. 8 and 9, it is readily observed that the front elevational view of the second embodiment in FIG. 8 corresponds to that of FIG. 5 for the first embodiment. The cross-sectional view of FIG. 9 is similar to FIG. 6, with the exception of the central depression 140 included in the first embodiment, so that only the three thicknesses of the multi- or tri-level construction of the second embodiment are illustrated.

Figure 10:
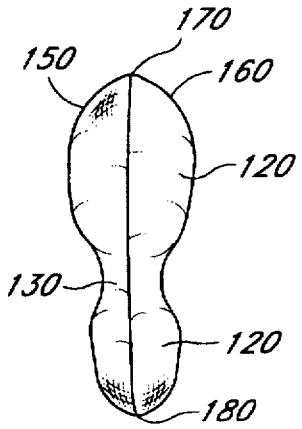
FIG. 10 is a side elevational view of the embodiment of FIG. 7, illustrating the tri-level construction.
Figure 11:
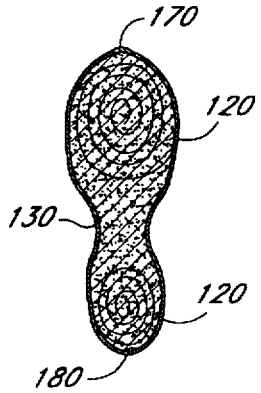
FIG. 11 is a cross-sectional view along lines 11—11 of FIG. 7, further illustrating the tri-level construction.

Likewise, in FIGS. 10 and 11 it is readily observed that the side elevational view of FIG. 10 corresponds to FIG. 3, while the cross-sectional view of FIG. 11 is similar to FIG. 4 except for the central depression 140.

FIGS. 12–16 illustrate a third preferred embodiment 220 of the present invention, wherein the features of the side cutouts 110 and the central depression 140 are included. In this embodiment, mirror images are obtained by halving the pillow 220 either transversely or longitudinally, since the neck rolls 120' have equal diameters.

Figure 12:
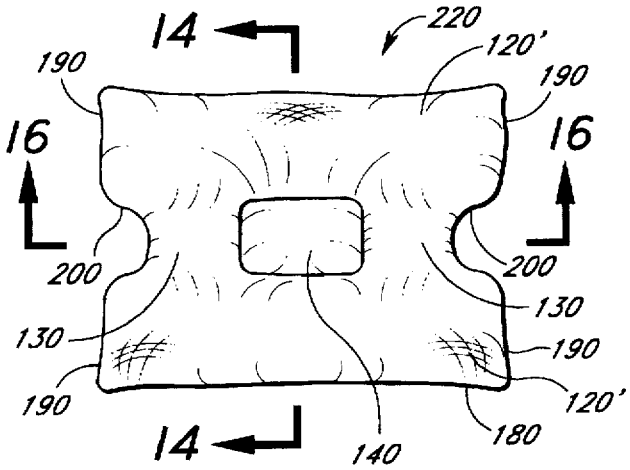
FIG. 12 is a top plan view of a third preferred embodiment of the present invention, illustrating the side cutouts and central depression.
Figure 13:
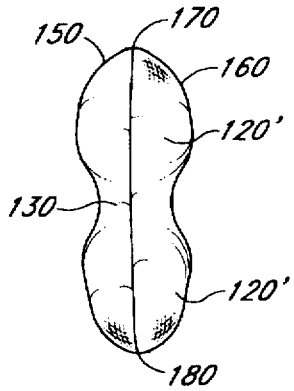
FIG. 13 is a side elevational view of the embodiment of FIG. 12, illustrating the equally sized neck rolls.
Figure 15:
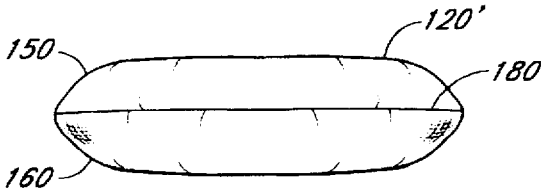
FIG. 15 is a front elevational view of the embodiment of FIG. 12, further illustrating the equally sized neck rolls.

Referring to FIG. 12, the central depression 140 provides the third and smallest thickness of the tri-level construction in this third embodiment. Although the elongated oval shape is again utilized, it is understood that any shape may be substituted while still achieving the advantages of the present invention.

Figure 14:
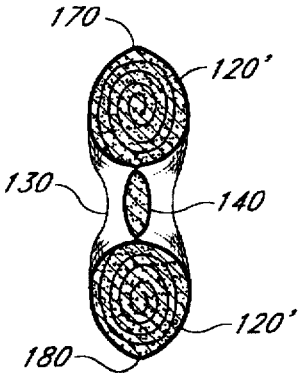
FIG. 14 is a cross-sectional view along lines 14—14 of FIG. 12, illustrating the tri-level construction.

Again, some comparisons may be noted between the views of FIGS. 13 and 3, FIGS. 14 and 4, and FIGS. 15 and 5. The side elevational view of FIG. 13 clearly shows that the top and bottom neck rolls 120' are equally sized, as does the front elevational view of FIG. 15. The cross-sectional view of FIG. 14 illustrates the three levels created by the neck rolls 120', the intermediate portion 130, and the central depression 140 for the pillow 220 of this third embodiment.

Figure 16:
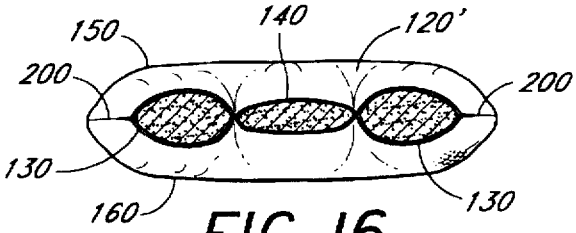
FIG. 16 is a cross-sectional view along lines 16—16 of FIG. 12, further illustrating the tri-level construction of the pillow.

The cross-sectional view of FIG. 16 corresponds to FIG. 6 of the first embodiment 100 of the cervical pillow constructed in accordance with the present invention. In this third embodiment 220, however, a view taken along lines 16—16 looking toward the bottom 180 of the pillow 220 would be a mirror image.

The cervical pillow of the present invention is preferably used with conventionally sized pillow cases that come in a variety of colors and print designs. That is, the pillow's length and width should conform with standard and king size pillow cases, for example, for the user's convenience. Although, specially sized pillow cases, perhaps of hypo-allergenic fabrics, may be manufactured in appropriate sizes and offered in conjunction with the pillow of the present invention.

The embodiments illustrated and described above are provided as examples of the cervical pillow of the present invention. One or two cutouts may be included and 2–4 levels of pillow thicknesses are provided. Other changes and modifications may be made from the embodiments presented herein by those skilled in the art without departure from the spirit and scope of the invention, as defined by the appended claims.

What is claimed is:

1. A pillow for head and neck support, comprising:

an upper casing of greater longitudinal dimension than lateral dimension;

a lower casing of size substantially equal to said upper casing;

a top edge and a bottom edge formed by said casings connected together along said longitudinal dimension;

a left side edge and a right side edge formed by said casings connected together along said lateral dimension;

a longitudinal first portion formed between said top and bottom edges;

a longitudinal second portion formed between said first portion and said bottom edge, said second portion substantially parallel to said first portion;

a third portion formed between said first and second portions, said third portion including a recessed central portion located between said left and right side edges, such that the thickness of said central portion is less than the thickness of said third portion in order to accommodate the back of a user's head; and a cutout formed on at least one of said side edges, said cutout providing air circulation and relieving pressure about the area of at least the nose and mouth of a side-sleeping user;

wherein said first portion contains a first neck roll having a first diameter, said second portion contains a second neck roll having a second diameter, said first diameter being greater than said second diameter, and the thickness of said third portion is less than the diameter of said neck rolls in order to align the head with the spinal column of the user during sleep on either the user's side or back, and wherein said first and second neck rolls comprise folded or rolled triangular sections of fibrous material and said central portion contains a plurality of layers of a fibrous material.

2. The pillow of claim 1, wherein said third portion contains a plurality of layers of a material.

3. The pillow of claim 1, wherein a material of said third portion and said neck rolls is formed of 100% polyester fiber.

4. The pillow of claim 1, wherein a second cutout is formed on the other of said side edges.

5. The pillow of claim 1, wherein said first, second, and third portions are separated by stitching.

6. The pillow of claim 1, wherein said central portion is stitched substantially in the shape of an elongated oval.

7. A pillow for head and neck support, comprising:

an upper casing of greater longitudinal dimension than lateral dimension;

a lower casing of size substantially equal to said upper casing;

a top edge and a bottom edge formed by said casings connected together along said longitudinal dimension;

a left side edge and a right side edge formed by said casings connected together along said lateral dimension;

a longitudinal first portion formed between said top and bottom edges;

a longitudinal second portion formed between said first portion and said bottom edge, said second portion substantially parallel to said first portion;

a third portion formed between said first and second portions said third portion including a recessed central portion located between said left and right side edges, such that the thickness of said central portion is less than the thickness of said third portion in order to accommodate the back of a user's head; and a cutout formed on at least one of said side edges, said cutout providing air circulation and relieving pressure about the area of at least the nose and mouth of a side-sleeping user;

wherein said first portion contains a first neck roll, said second portion contains a second neck roll and the thickness of said third portion is less than the diameter of said neck rolls in order to align the head with the spinal column of the user during sleep on either the user's side or back.

8. The pillow in accordance with claim 7, wherein said first neck roll has a first diameter and said second neck roll has a second diameter, and said first diameter is greater than said second diameter.

9. The pillow in accordance with claim 7, wherein said neck rolls comprise folded or rolled triangular sections of fibrous material.

10. The pillow in accordance with claim 7, wherein a distance from said top edge to said third portion is greater than the distance from said bottom edge to said third portion.

11. The pillow in accordance with claim 7, wherein a cutout is positioned in each side edge.

* * * * *